US005497307A

United States Patent [19]

Bae et al.

[11] Patent Number: 5,497,307

[45] Date of Patent: Mar. 5, 1996

[54] ILLUMINATING JEWELRY

[76] Inventors: Tae H. Bae; Sang Y. Bae; Sang I. Bae, all of 6898 Old Annapolis Rd., Linthicum, Md. 21090

[21] Appl. No.: 496,007

[22] Filed: Jun. 28, 1995

[51] Int. Cl.[6] ..... F21L 15/08

[52] U.S. Cl. ..... 362/104; 63/1.1; 362/802; 362/806

[58] Field of Search ..... 362/104, 103, 362/276, 802, 806, 363, 391, 809, 811; 63/1.1, 12

[56] References Cited

U.S. PATENT DOCUMENTS

| | | | |
|---|---|---|---|
| 3,383,503 | 5/1968 | Montegomery | 362/104 |
| 3,689,758 | 9/1972 | Power | 362/104 |
| 3,968,357 | 7/1976 | Hamilton | 63/1.1 X |
| 4,237,525 | 12/1980 | Deter | 362/104 |
| 5,018,053 | 5/1991 | Belknap et al. | 362/104 |

*Primary Examiner*—Stephen F. Husar

[57] ABSTRACT

An illuminating jewelry includes a housing containing a mercury switch, a mercury battery, a cap containing a light bulb, and a clipping member for clipping to the wearer, whereby anytime the illuminating jewelry is moved, the jewelry illuminates in a blinking manner.

8 Claims, 1 Drawing Sheet

ILLUMINATING JEWELRY

BACKGROUND OF THE INVENTION

1. Field of the Invention

The present invention relates to illuminating jewelry and more particularly, to an improved illuminating jewelry such as an earring, a necklace, a ring, a body ornament and the like, having a mercury battery, a mercury switch, and a light bulb, for illuminating the light bulb anytime the wearer moves.

2. Description of Related Art

Various types of illuminating jewelry such as earrings, necklaces, rings, body ornaments, and the like are known in the art. Generally, such conventional illuminating jewelries have batteries, a light bulb, an on/off switch, and a light emitting diode (LED), as shown in U.S. Pat. No. 3,383,503 to Montgomery, U.S. Pat. No. 3,689,758 to Power, U.S. Pat. No. 3,968,357 to Hamilton, and U.S. Pat. No. 4,237,525 to Deter. However, such conventional jewelries suffer from a number of problems such as, for example, they are either too big and bulky or if made sufficiently small and light weight, they are too short-lived to be commercially practical. Furthermore, with this conventional illuminating jewelry it is extremely difficult to provide the necessary switch member to turn off the illumination when the jewelry is not in use and it is insufficient as an ornament device to cyclically flash the jewelry.

SUMMARY OF THE INVENTION

Accordingly, it is an object of the present invention to provide an illuminating jewelry such as an earring, a necklace, a ring, a body ornament, and the like, which eliminates the above problems encountered in the conventional illuminated jewelry.

Another object of the present invention is to provide an improved illuminating jewelry including a miniature battery, a light bulb, a mercury switch, and a clip member, whereby anytime the wearer moves, the jewelry illuminates.

A further object of the present invention is to provide illuminating jewelry which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to illuminating jewelry including, a housing containing a mercury switch, a mercury battery, a transparent cap containing a light bulb, and a clip member for attaching the illuminating jewelry to the wearer, whereby anytime the wearer moves, the illuminating jewelry illuminates in a blinking manner or other manners.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
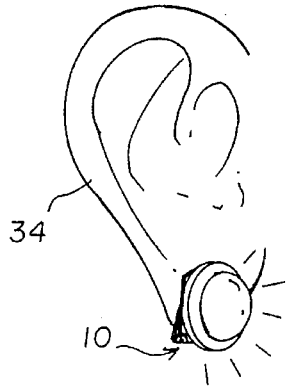
FIG. 1 is a side view examplarily illustrating the manner in which an illuminating earring according to an embodiment of the present invention is worn.
Figure 2:
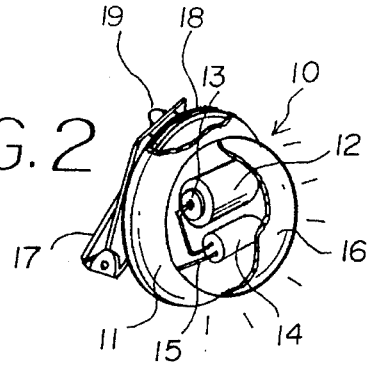
FIG. 2 is one perspective view of the illuminating earring according to the embodiment of the present invention containing a cut-away portion which illustrates the construction thereof.
Figure 3:
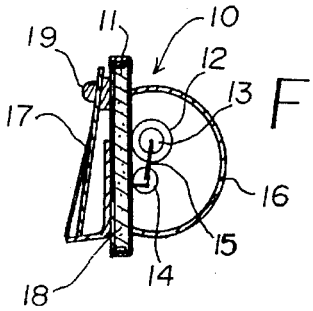
FIG. 3 is a sectional view of FIG. 2.

Referring now in detail to the drawings for the purpose of illustrating preferred embodiments of the present invention, the illuminating jewelry 10 shown as example in FIGS. 1, 2, and 3, includes a housing 11 containing a mercury cell battery 18, an envelope mercury switch 12, a light bulb 14, a dome cap 16 covering the mercury switch 12 and the light bulb 14, and a clip member 17 fixedly attached to the housing 11. The envelope mercury switch 12 is connected to the light bulb 14 and mercury battery 18 through conductive wires 15. The clip member 17 has a handling button 19 for clipping to the ear 34. The dome cap 16 may be transparent, colored, or differently configured.

Figure 6:
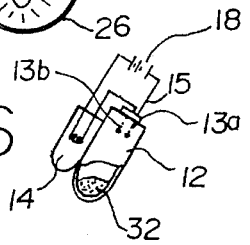
FIG. 6 is a front elevational view of a mercury switch with portions broken away to show an off-position according to the embodiments of the present invention.
Figure 7:
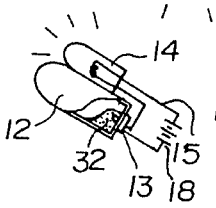
FIG. 7 is a front elevational view of the mercury switch with portions broken away to show an on-position according to the embodiments of the present invention.

As shown in FIGS. 6 and 7, the envelope mercury switch 12 includes a mercury bubble 32 disposed therewithin, a first contact 13*a* connected to the cell battery 18 and a second contact 13*b* connected to the light bulb 14 through conductive wires 15.

The illuminating jewelry 10 according to a preferred embodiment of the present invention operates as follows. When the wearer wearing the illuminating jewelry 10 does not trigger movement of the jewelry 10, there is no activation of the light bulb 14 since the mercury switch 12 remains to be on the off-position as shown in FIG. 6. However, when the wearer causes movement to the jewelry 10, the mercury bubble 32 is moved to contact both the first and second contacts 13*a* and 13*b*, thereby illuminating the light bulb 14 automatically. Accordingly, anytime the wearer wearing the present jewelry moves, the light bulb 14 illuminates in a blinking manner.

Figure 4:
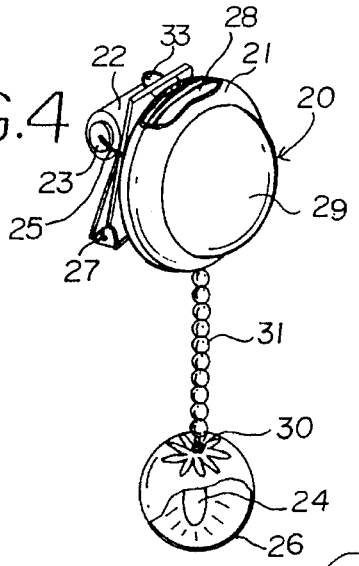
FIG. 4 is a perspective view of another embodiment of the illuminating earring of the present invention containing a cut-away portion which illustrates the construction thereof.
Figure 5:
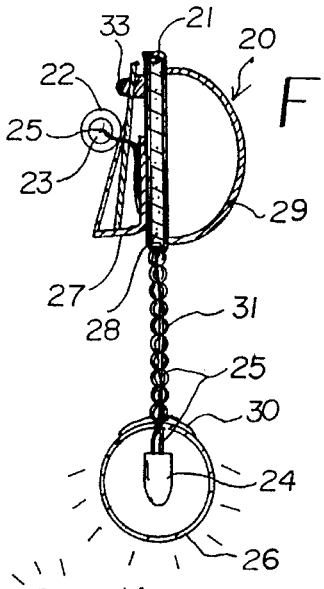
FIG. 5 is a sectional view of FIG. 4.

Referring to FIGS. 4 and 5, there is an additional embodiment of an illuminating jewelry according to the present invention. The illuminating earring 20 includes a ring housing 21 containing a mercury cell battery 28, an ornamental member 29 fixed to one outer surface of the housing 21, a clip member 27 fixed to the other outer surface of the housing 21, a handling portion 33 for easily operating the clip member 27, and an envelope mercury switch 22 attached to the clip member 27.

The illuminating earring 20 further includes a ball cap 26 having a light bulb 24 therein, conductive wires 25 for connecting the light bulb 24, the mercury battery 28 and the mercury switch 22, and an interconnection link 31 for linking the ring housing 21 and a ornamental cap 30 attached to the ball cap 26. The ball cap 26 can be transparent, colored, or differently configured.

The illuminating jewelry 20 according to this embodiment of the present invention operates the same way as the illuminating jewelry 10 shown in FIG. 2. Here, the appreciation for the illuminating jewelry 20 can be enhanced as the ball cap 26 is illuminated.

Accordingly, these illuminating jewelries 10 and 20 are simple in structure, inexpensive to manufacture, refined in appearance, and practically in use. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An illuminating jewelry comprising:

a housing including a mercury battery;

a cap including a light bulb connected to said mercury battery;

an envelope mercury switch connected to said light bulb and said mercury battery through conductive wires; and clipping means for clipping to a wearer, said clipping means attached to said housing, whereby anytime said illuminating jewelry is moved, said light bulb is illuminated.

2. The illuminating jewelry of claim 1, wherein said housing has a ring configuration.

3. The illuminating jewelry of claim 1, wherein said cap includes said light bulb and said envelope mercury switch disposed therewithin.

4. The illuminating jewelry of claim 1, wherein said cap has a ball configuration.

5. The illuminating jewelry of claim 4, wherein said envelope mercury switch is fixedly attached to said clipping means.

6. The illuminating jewelry of claim 5, wherein said clipping means further including a handling button for easily operating said clipping means.

7. The illuminating jewelry of claim 1, wherein said envelope mercury switch includes a mercury bubble, and a pair of contacts for determining an on-position and an off-position of said mercury switch depending on whether or not said mercury bubble contacts said pair of contacts.

8. The illuminating jewelry of claim 1, wherein said light bulb is illuminated in a blinking manner.

* * * * *